United States Patent [19]

Kelso et al.

[11] 4,078,598

[45] Mar. 14, 1978

[54] STRONGBACK AND METHOD FOR POSITIONING SAME

[75] Inventors: Walter T. Kelso; Frank T. Obrochta, both of East Hartford, Conn.

[73] Assignee: United Technologies Corporation, Hartford, Conn.

[21] Appl. No.: 722,182

[22] Filed: Sep. 10, 1976

[51] Int. Cl.[2] ..... B22C 9/10; B22C 7/02

[52] U.S. Cl. ..... 164/30; 164/35; 164/60; 164/235; 164/246

[58] Field of Search ..... 164/30, 26, 60, 351, 164/365, 366, 35, 36, 43, 165, 166, 361; 249/146, 147, 149, 125

[56] References Cited

U.S. PATENT DOCUMENTS 3,965,963 6/1976 Phipps et al. ..... 164/60

*Primary Examiner*—Francis S. Husar
*Assistant Examiner*—John S. Brown
*Attorney, Agent, or Firm*—Edward J. Timmer

[57] ABSTRACT

The present invention provides means for the improved positioning of a strongback in a pattern mold for formation of expendable patterns thereon. Investment casting molds formed around the assembly of strongback and patterns are characterized as having the strongback precisely and reproducibly suspended therein. Articles, such as turbine blade halves, cast in such investment molds have mating surfaces in close dimensional relationship and can be bonded one to any mating other to form a finished product.

In particular, a strongback having bonding locators near the opposite ends thereof is provided with additional locators to be used in suspending the strongback in the pattern mold. According to the invention, these pattern mold locators are colinear with and in close proximity to the bonding locators and are engaged by locating means in the pattern mold for establishing precise positioning of the strongback therein.

14 Claims, 9 Drawing Figures

FIG. 1
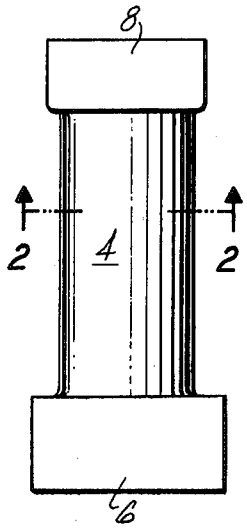
FIG. 2
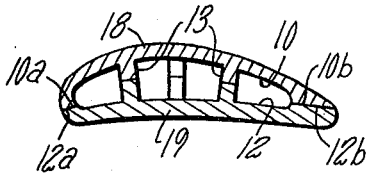
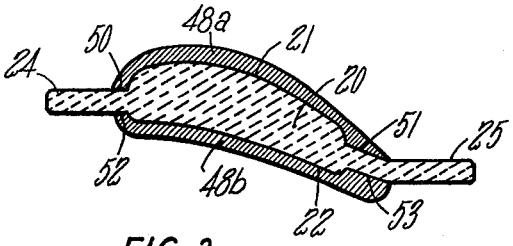
FIG. 3
FIG. 4
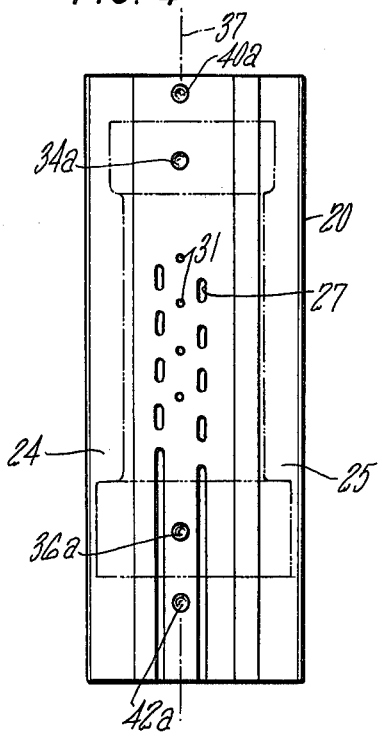
FIG. 5
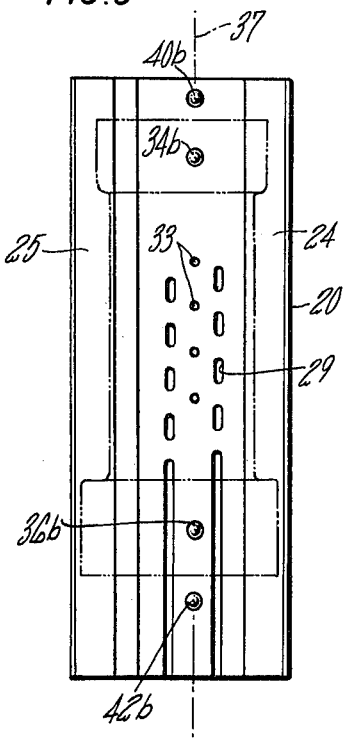

FIG. 7
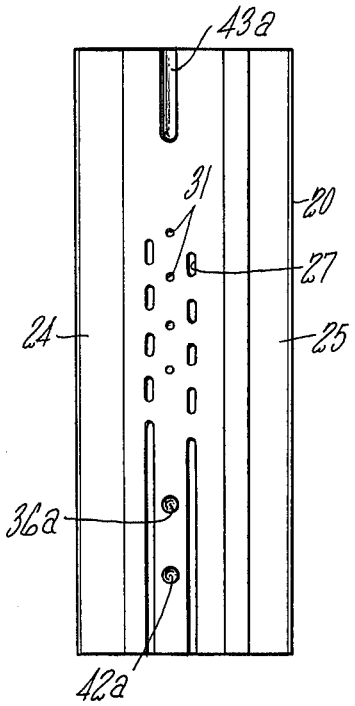
FIG. 8
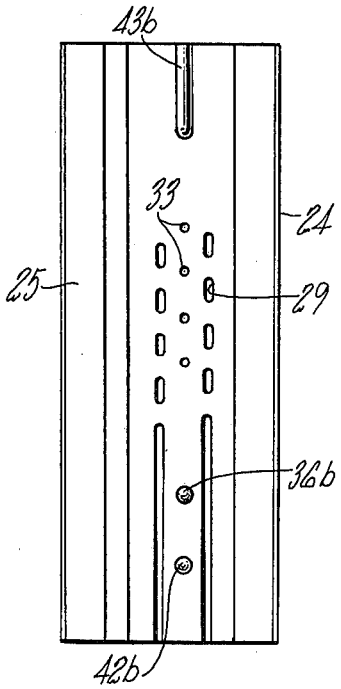
FIG. 6
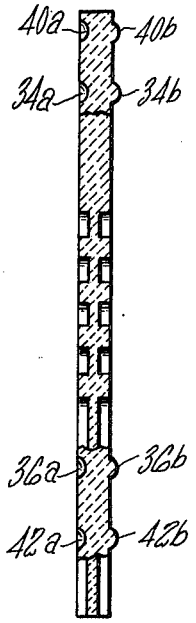
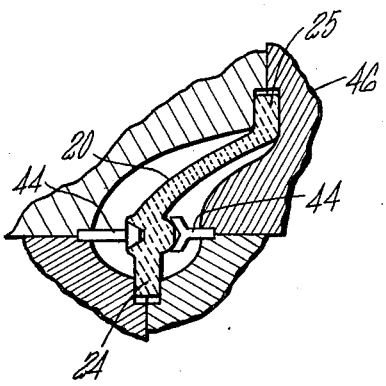
FIG. 9

STRONGBACK AND METHOD FOR POSITIONING SAME

BACKGROUND OF THE INVENTION

1. Field of the Invention

The present invention relates to an improved strongback and method for suspending the strongback in a pattern mold and ultimately in an investment mold for casting mating articles.

2. Description of the Prior Art

Copending patent application Ser. No. 499,227, now U.S. Pat. No. 3,981,344 entitled "Investment Casting Mold and Process" and assigned to the assignee of the present invention describes a method for making a cast product, such as a hollow gas turbine blade, wherein the product is cast in opposed, mating halves on opposite sides of a central mold element suspended rigidly in the mold cavity of an investment shell mold. The central mold element utilized in the disclosed process is referred to as a strongback and includes article-forming surfaces on opposite sides thereof and edge flanges extending beyond these surfaces to be embedded in the shell mold. In making turbine blades and the like in accordance with the disclosed technique, the strongback is provided with bonding locators near the opposite ends of the article-forming surfaces. The locators may be in the form of a detent and mating projection on opposite sides of the strongback and are used to effect precision alignment of the blade halves for subsequent bonding. Such bonding locators are illustrated in the Hayes and Phipps patent, U.S. Pat. No. 3,965,963, with respect to a somewhat different casting process. As shown but not discussed in the patent, these locators are substantially colinear with the so-called design datum line of the turbine blade and strongback, which line is widely used as the reference line from which the blade and strongback structural features are measured and positioned.

In the casting process disclosed in the above-mentioned patent application, a critical step involves the attachment of the wax patterns of the article halves to the opposite sides of the strongback. If the patterns are not attached in precise dimensional relationship to the strongback and to one another, the investment shell mold formed around the assembly will have a strongback incorrectly suspended therein, thus producing misoriented blade halves when molten metal is solidified therein. The most commonly used technique for pattern attachment involves suspending the strongback in a pattern mold and injecting molten wax therein to form the patterns directly on each article-forming surface of the strongback. In this technique, locating means, such as knife edges, tabs and the like, are provided in the pattern mold to engage the outer edge periphery or perimeter of the strongback and locate it in proper relation in the mold. However, this technique introduces error in positioning the strongback in several ways. First, the outer edge perimeter of the strongback is made within a definable tolerance range, such as ± 0.005 inch, and therefore varies in dimension from one strongback to the next. Location of the strongbacks with reference to such a variable outer perimeter thereby results in positional variations of the strongbacks, and bonding locators thereon, in the pattern mold. Second, the ceramic or refractory material from which the strongback is made exhibits shrinkage during various stages of the process. When the strongback is positioned with reference to its outer perimeter, the amount of shrinkage between the design datum line with which the bonding locators are substantially colinear and the outer perimeter is oftentimes significant and introduces another source for strongback positioning variations. Third, the locating means provided in the pattern mold for engagement with the outer perimeter must have dimensional and positional tolerances to accept the variable strongback perimeter. As a result, some strongbacks are not held as rigidly as others and have been known to shift position in the mold when the molten wax is injected therein under pressure. Of course, these strongback positioning errors lead to misoriented wax patterns and eventually to the production of investment molds having the strongback imprecisely suspended therein. Articles cast in such investment molds may exhibit significant dimensional variations, such as in the thickness of the turbine blade wall, which are cause for rejection of the casting. An equally detrimental result is that article halves cast in different investment molds cannot be satisfactorily mated and bonded together as a result of the imprecise dimensional relationship therebetween. In the mass production of articles, such as turbine blades, it is highly desirable, if not imperative, that turbine blade halves cast in different investment molds be capable of subsequent mating and bonding to one another to produce the finished blade.

Copending U.S. patent application Ser. No. 722,181 entitled "Method for Positioning A Strongback" of Robert A. Herold has a common assignee with the present invention and provides a method for the improved positioning of a strongback in a pattern mold for formation of expendable, article-shaped patterns thereon. Improved positioning of the strongback in the pattern mold is achieved by suspending the strongback from the bonding locators by expendable locating means; that is, locating means which are incorporated into the patterns formed on the strongback surfaces. The use of expendable locating means enables the bonding locators to also serve as locators for positioning the strongback in the pattern mold and essentially eliminates dimensional and other tolerances associated with the prior art technique of outer perimeter location.

SUMMARY OF THE INVENTION

Accordingly, the present invention provides means for the improved positioning of a strongback, such as a precast ceramic strongback, in a pattern mold for formation of expendable, article-shaped patterns thereon. Investment molds subsequently formed around the assembly of strongback and patterns are characterized as having the strongback precisely and reproducibly suspended therein.

In the practice of the present invention, such improvements are achieved by suspending and locating the strongback in the pattern mold from points on the strongback which are colinear with and in close proximity to the bonding locators. The colinearity and proximity of the mold location points to the bonding locators significantly reduce dimensional and other tolerances therebetween and enable more precise and reproducible positioning of the strongback in relation to the pattern mold, to the expendable patterns formed thereon and ultimately to the investment mold formed therearound than has heretofore been available.

In a typical embodiment of the invention, a strongback having article-forming surfaces on opposite sides thereof and bonding locators near the ends of said surfaces is provided with additional locators to be used in suspending and locating the strongback in the pattern mold. According to the invention, these pattern mold locators are colinear with and in close proximity to the bonding locators, one pattern mold locator being associated with each bonding locator. The mold locators may be similar in form to the bonding locators; that is, a detent and mating projection on opposite sides of the strongback, and preferably are disposed outwardly from the bonding locators nearer the ends of the strongback on surfaces which are removed from the cast articles prior to bonding. Suspension of the strongback in the pattern mold is achieved by providing precisely dimensioned and positioned locating means, such as pins or the like, in the mold. When brought into engagement with the mold locators near each end of the strongback, the locating means position the strongback precisely in the pattern mold. Since dimensional and other tolerances between the mold and bonding locators are significantly reduced in the present invention, positioning of the strongback in the pattern mold is much more precise than heretofore available with the prior art technique of outer perimeter location. In addition, shifting of the strongback when pattern material is introduced into the mold is significantly reduced, if not eliminated, by utilizing locating means which intimately engage the pattern mold locators.

An important feature of the present invention is that such precise positioning can be reproduced among large numbers of strongbacks, since the mold and bonding locators are readily cast or molded into each strongback with minimum tolerance variation therebetween. The present invention thus provides a method for making large numbers of investment molds having the strongback precisely suspended therein in substantially identical fashion. Articles cast in such molds will have mating surfaces in close dimensional relationship and can be bonded one to any mating other with the aid of the bonding locators to produce a finished product, regardless of whether the articles are cast in the same or in different molds.

These and other objects and advantages will appear more fully from the following detailed description of the preferred embodiment.

BRIEF DESCRIPTION OF THE DRAWING

FIG. 1 is a plan view of the turbine blade to be produced.

FIG. 2 is a sectional view through the blade of FIG. 1.

FIG. 3 is a sectional view through a strongback with the patterns thereon in readiness for forming a shell mold.

FIG. 4 is a plan view of a side of the strongback.

FIG. 5 is a plan view of the opposite side of the strongback.

FIG. 6 is a sectional view through the strongback showing the configuration of the bonding locators and mold locators.

FIG. 7 is a plan view of a side of the strongback showing a modified mold and bonding locator at one end.

FIG. 8 is a plan view of the opposite side of the strongback.

FIG. 9 is a sectional view through the pattern mold with the strongback suspended therein.

DESCRIPTION OF THE PREFERRED EMBODIMENT

Although the exemplary embodiment set forth in detail below relates to the formation of investment molds having a strongback suspended therein for casting gas turbine blade halves, it is offered merely for illustration and is not intended to limit the scope of the present invention.

Referring to FIG. 1, the turbine blade to be produced is shown as including an airfoil portion 4, a root portion 6 and a shroud portion 8. The blade is hollow, FIG. 2, and has internal, opposed surfaces 10 and 12 having pedestals or ribs 13 projecting therefrom to define cooling air paths in the completed blade.

The present invention follows the teachings of copending U.S. application Ser. No. 499,227, now U.S. Pat. No. 3,981,344 described hereinbefore, to produce the blade by casting blade halves 18 and 19 on opposite sides of a central mold element or strongback. The strongback 20 utilized in the present invention is illustrated in FIGS. 3, 4 and 5 and has article-forming surfaces on opposite sides 21 and 22 thereof, these surfaces having the configuration of the internal surfaces 10 and 12 of the blade, including mating surfaces 10*a* and 12*a* and 10*b* and 12*b*. The strongback also has opposite edges extending beyond the article-forming surfaces to form side flanges 24 and 25 which become embedded in the investment shell mold. As shown most clearly in FIGS. 4 and 5, the article-forming surfaces (defined by the dotted lines) have appropriate slots 27 and 29 and recesses 31 and 33 to form 13 in the cast blade halves. Since the ribs must cooperate on the opposed blade halves, the slots and recesses are in mirror relation to one another. The article-forming surfaces are also shown as having bonding locators 34*a* and *b* and 36*a* and *b* near the ends thereof colinear with the design datum line 37 determined for the blade. Each bonding locator is in the form of a detent and mating projection 34*a* and *b* and 36*a* and *b* on opposite sides of the strongback, FIG. 6, and provides a similar locator, in reverse, on the cast blade halves for subsequent mating and bonding alignment. Of course, those skilled in the art will recognize that other forms of bonding locators may be utilized as desired.

As shown most clearly in FIGS. 4 and 5, additional locators 40*a* and *b* and 42*a* and *b* are provided on opposite sides 21 and 22 of the strongback for use in positioning the strongback in the pattern mold. These pattern mold locators are colinear with and in close proximity to the bonding locators, one mold locator, such as 40*a* and *b*, being associated with each bonding locator, such as 34*a* and *b*. Preferably, the mold locators are disposed outwardly from the bonding locators nearer the ends of the strongback on nonarticle-forming surfaces; that is, on strongback surfaces which produce surfaces on the cast blade halves that are cut from or otherwise removed from the castings prior to bonding. The particular advantage of this preferred embodiment will become apparent hereinbelow. The mold locators may be similar in form to the bonding locators, such as in FIG. 6, or different, such as comprising holes through the strongback, the particular form of mold locator depending upon the locating means used to suspend the strongback in the pattern mold. In addition, the mold and bonding locators at one end of the strongback may be in the form of a longitudinal ridge 43*a* and mating slot 43*b*, FIGS.

7 and 8 to facilitate mating of the bonding locators together prior to the bonding operation.

In one embodiment of the invention, the locating means in the pattern mold may comprise fixed or retractable rod-like pins 44, FIG. 9, adapted to intimately engage the detent and projection of each mold locator. Similar rod-like pins may be used if the strongback has locators as shown in FIGS. 7 and 8. In another embodiment, the locating means may include rod-like pins adapted to extend through the strongback in which case the pattern mold locators would comprise holes therein. Of course, other versions of locating means and cooperating mold locators may be used in the present invention. Regardless of the version chosen, the locating means must be precisely dimensioned and positioned in the pattern mold 46 (shown as a four part mold) so that upon engagement with the mold locators, the strongback is precisely positioned in the mold cavity, FIG. 9. Such locating means and pattern molds are well known in the art.

The important and critical feature of the present invention is that the strongback be suspended from points thereon which are colinear with and in close proximity to the bonding locators. If this relationship is established, positioning of the strongback in the pattern mold will be significantly more precise than that available with the prior art technique of outer perimeter location. For example, since the bonding and mold locators described above can be cast or molded into the strongback with a maximum tolerance, such as ± 0.001 inch, therebetween, the strongback can be suspended in the pattern mold with similar precision. This in contrast to the prior art technique wherein the outer perimeter may vary by as much as 0.010 inch from one strongback to the next, resulting in similar positioning errors of the strongback in the mold. In addition, by utilizing locating means which intimately engage the mold locators, as in FIG. 9, shifting of the strongback in the pattern mold when pattern material is introduced therein can be substantially reduced, if not eliminated.

Since large numbers of strongbacks can be readily manufactured with mold and bonding locators disposed thereon in accordance with the invention, reproducibility in the positioning of such strongbacks in the pattern mold is readily attained. As will be evident from the discussion below, this is highly advantageous in the mass production of turbine blades and like products.

After the strongback is suspended in the pattern mold cavity, pattern material, such as molten wax, is introduced therein to form patterns 48*a* and *b* directly on the opposite sides of the strongback, FIG. 3, the wax patterns having complementary and mating surfaces 50 and 52 and 51 and 53 corresponding to those to be provided on the cast blade halves. An assembly of strongback and patterns is thus produced and is ready for subjection to investment shell mold formation operations. As mentioned hereinabove, the pattern mold locators are preferably disposed on nonarticle-forming surfaces of the strongback. This preferred embodiment is desirable since the locating pins will produce holes or other defects in the wax patterns where the pins engage the mold locators. If these defects are situated on nonarticle-forming surfaces, they do not adversely affect the quality of the cast articles and therefore need not be plugged or otherwise repaired. However, if the mold locators are situated on article-forming surfaces, the holes or defects produced by the locating pins must be repaired to assure a quality casting, taking care not to inadvertently damage other critical pattern surfaces in the process.

The assembly of strongback and patterns thereon is then subjected to conventional and well-known shell mold formation operations, including successively and repeatedly dipping the assembly in ceramic slurry, stuccoing with ceramic particulate and drying until the desired thickness for a mold wall is obtained. The ceramic coated assembly is then heated to melt out the wax patterns and cure the ceramic coating into a strong mold to be used in casting. An investment mold having the strongback precisely suspended therein is thereby produced. Since large numbers of strongbacks having the bonding and mold locators precisely disposed thereon can be readily manufactured and since each of these can be reproducibly suspended in the pattern mold for pattern attachment, large numbers of investment molds having the strongback precisely suspended therein in substantially indentical fashion are now made available by the present invention. Blade halves or other articles cast in such investment molds; for example by well-known processes, such as the directional solidification processes of U.S. Pat. Nos. 3,260,505; 3,494,709; and 3,793,010, will have mating surfaces in close dimensional relationship and can be bonded one to any mating other with the aid of the bonding locators to produce a finished blade, regardless of whether the blade halves were cast in the same or in different molds. In the mass production of blades for gas turbine engines, this feature of the present invention results in improved yields, lower production costs, and a better quality blade.

Although the preferred embodiment has been described above in relation to casting turbine blade halves, it will be readily understood by those skilled in the art that other articles can be cast with the aid of the present invention. Of course, the design datum line with which the bonding locators are substantially colinear will lie differently on different article shapes. However, this line may be readily calculated and determined by those skilled in the art for each shape. Those skilled in the art will also recognize that other changes, omissions and additions in the form and detail of the preferred embodiment may be made without departing from the spirit and scope of the present invention.

Having thus described typical embodiments of our invention, that which we claim as new and desire to secure by Letters Patent of the United States is:

1. In making investment molds having a strongback suspended in the mold cavity thereof for casting articles having mating surfaces to be subsequently bonded together, wherein a strongback having bonding locators is first suspended in the mold cavity of a pattern mold for formation of expendable patterns of the articles thereon and then the assembly of strongback and patterns is surrounded by an investment mold, the improvement which comprises increasing the precision and reproducibility with which the strongback is positioned in the investment molds, including:

suspending the strongback in the pattern mold from points on said strongback which are colinear with and in close proximity to said bonding locators, the colinearity and proximity of said points to the bonding locators significantly reducing dimensional and other tolerances therebetween and improving the precision and reproducibility with which the strongback is positioned in relation to the pattern mold, to the patterns formed thereon and consequently to the investment mold ultimately formed therearound.

2. The method of claim 1 wherein the points from which the strongback is suspended are disposed outwardly from the bonding locators nearer the ends of the strongback on surfaces which produce article surfaces that are removed prior to bonding.

3. The method of claim 1 wherein the points from which the strongback is suspended are in the form of detents and mating projections on opposite sides of the strongback.

4. The method of claim 3 wherein the strongback is suspended by rod-like pins intimately engaging said detents and projections.

5. The method of claim 1 wherein the points from which the strongback is suspended are portions of said sides defining holes through the strongbacks.

6. The method of claim 5 wherein the strongback is suspended by rod-like pins extending through the holes.

7. The method of claim 1 wherein the points from which the strongback is suspended include a detent and mating projection on opposite sides thereof at one end and a longitudinal ridge and mating slot on opposite sides at the other end.

8. The method of claim 7 wherein the strongback is suspended by rod-like pins intimately engaging said detent and projection and said ridge and slot.

9. A strongback of the type having article-forming surfaces on opposite sides thereof against which articles are cast and colinear bonding locators near the opposite ends of said surfaces for providing bonding locators on the cast articles, wherein the improvement comprises:

pattern mold locators disposed on said sides of the strongback colinear with and in close proximity to the bonding locators, one mold locator being associated with each bonding locator, the colinearity and proximity of the mold locators to the bonding locators significantly reducing dimensional and other tolerances therebetween and enabling precise and reproducible positioning of the strongback in a pattern mold for formation of expendable patterns of the articles on said article-forming surfaces.

10. The strongback of claim 9 wherein the pattern mold locators are disposed outwardly from the bonding locators nearer the ends of the strongback on surfaces which produce article surfaces that are removed prior to bonding.

11. The strongback of claim 9 wherein the mold locators each comprise a detent and mating projection on opposite sides of the strongback.

12. The strongback of claim 9 wherein the mold locators each include portions of said sides defining holes through the strongback.

13. The strongback of claim 9 wherein the mold and bonding locator at one end of the strongback comprise a longitudinal ridge and mating slot on opposite sides of the strongback to facilitate bonding alignment.

14. The strongback of claim 9 wherein the article-forming surfaces have the configuration of the internal, opposed surfaces of a hollow turbine blade, including mating surfaces to be subsequently bonded together.

* * * * *